US011589145B2

(12) United States Patent
Jiang

(10) Patent No.: US 11,589,145 B2
(45) Date of Patent: Feb. 21, 2023

(54) CONNECTING STRUCTURE, LOUDSPEAKER AND ELECTRONIC APPARATUS HAVING THE CONNECTING STRUCTURE

(71) Applicants: K-TRONICS (SUZHOU) TECHNOLOGY CO., LTD., Jiangsu (CN); BOE TECHNOLOGY GROUP CO., LTD., Beijing (CN)

(72) Inventor: Jiahong Jiang, Beijing (CN)

(73) Assignees: K-TRONICS (SUZHOU) TECHNOLOGY CO., LTD., Suzhou (CN); BOE TECHNOLOGY GROUP CO., LTD., Beijing (CN)

( * ) Notice: Subject to any disclaimer, the term of this patent is extended or adjusted under 35 U.S.C. 154(b) by 349 days.

(21) Appl. No.: 16/623,530

(22) PCT Filed: Apr. 16, 2019

(86) PCT No.: PCT/CN2019/082880
§ 371 (c)(1),
(2) Date: Dec. 17, 2019

(87) PCT Pub. No.: WO2019/201240
PCT Pub. Date: Oct. 24, 2019

(65) Prior Publication Data

US 2021/0152904 A1 May 20, 2021

(30) Foreign Application Priority Data

Apr. 16, 2018 (CN) ..... 201820539582.4

(51) Int. Cl.
*H04R 1/02* (2006.01)

(52) U.S. Cl.
CPC ..... *H04R 1/025* (2013.01)

(58) Field of Classification Search
CPC ..... H04R 1/025
(Continued)

(56) References Cited

U.S. PATENT DOCUMENTS 6,310,961 B1 * 10/2001 Oliveira ..... H04R 25/656 381/328
10,511,797 B2 12/2019 Wang
(Continued)

FOREIGN PATENT DOCUMENTS

CN 106110617 A 11/2016
CN 107611656 A 1/2018
(Continued)

OTHER PUBLICATIONS

The extended European search report dated Dec. 9, 2021; Appln. No. 19787712.9.

*Primary Examiner* — Sean H Nguyen

(57) ABSTRACT

A connecting structure, as well as a loudspeaker and an electronic apparatus having the connecting structure are disclosed. The connecting structure includes a snap ring and a connecting post. The snap ring is provided with a notch having a width greater than an inner diameter of the snap ring and an inner wall of the snap ring is provided with a supporting arm. The connecting post includes a post body and a post head located at one end of the post body, an outer diameter of the post head is greater than an outer diameter of the post body, and the post body is provided with a snap-fitting slot. The post body can pass through the notch of the snap ring to be snap-fitted in the snap ring, and the supporting arm can be snap-fitted in the snap-fitting slot of the connecting post.

19 Claims, 4 Drawing Sheets

(58) Field of Classification Search
USPC ..... 381/386
See application file for complete search history.

(56) References Cited

U.S. PATENT DOCUMENTS

| | | | | |
|---|---|---|---|---|
| 10,823,323 | B2 * | 11/2020 | Fremont | F16L 55/11 |
| 2004/0114773 | A1 | 6/2004 | Jensen et al. | |
| 2005/0147269 | A1 * | 7/2005 | Oliveira | H04R 1/10<br>381/382 |
| 2006/0180330 | A1 * | 8/2006 | Auray | H01R 13/741<br>174/44 |
| 2008/0170724 | A1 * | 7/2008 | Cancelmo | H04R 1/083<br>381/104 |
| 2010/0167827 | A1 * | 7/2010 | Yamazaki | F16D 3/845<br>464/141 |
| 2012/0294466 | A1 * | 11/2012 | Kristo | H04R 25/606<br>381/322 |
| 2013/0007955 | A1 * | 1/2013 | Elkington | H04R 27/00<br>4/496 |
| 2020/0146162 | A1 | 5/2020 | Shan | |

FOREIGN PATENT DOCUMENTS

| | | | |
|---|---|---|---|
| CN | 208079382 | U | 11/2018 |
| WO | 2017/202143 | A1 | 11/2017 |

* cited by examiner

CONNECTING STRUCTURE, LOUDSPEAKER AND ELECTRONIC APPARATUS HAVING THE CONNECTING STRUCTURE

The present application claims priority of China Patent application No. 201820539582.4 filed on Apr. 16, 2018 under the title of "CONNECTING STRUCTURE AND ELECTRONIC APPARATUS HAVING THE CONNECTING STRUCTURE", the content of which is incorporated in its entirety as portion of the present application by reference herein.

TECHNICAL FIELD

Embodiments of the present disclosure relate to a connecting structure, as well as a loudspeaker and an electronic apparatus having the connecting structure.

BACKGROUND

In an electronic apparatus, it usually needs to connect two devices with each other. By taking a connection between a loudspeaker and a sound box as an example, currently, the loudspeaker is commonly fixed at the sound box by using a threaded element such as a screw and a bolt.

SUMMARY

At least one embodiment of the present disclosure provides a connecting structure as well as a loudspeaker and an electronic apparatus having the connecting structure, which can increase a space utilization, simplify a manufacturing process and reduce a manufacturing cost.

In order to achieve the objective(s) above, embodiments of the present disclosure adopt technical solution(s) as below.

On one aspect, an embodiment of the present disclosure provides a connecting structure including a snap ring and a connecting post. The snap ring is provided with a notch, a width of the notch is greater than an inner diameter of the snap ring, and an inner wall of the snap ring is provided with a supporting arm. The connecting post includes a post body and a post head located at one end of the post body, an outer diameter of the post head is greater than an outer diameter of the post body, and the post body is provided with a snap-fitting slot. The post body of the connecting post is capable of passing through the notch of the snap ring to be snap-fitted in the snap ring, and the supporting arm of the snap ring is capable of being snap-fitted in the snap-fitting slot of the connecting post.

In an example, the connecting structure is configured to connect a first device with a second device. The first device is provided with a connecting channel and the second device is provided with a connecting hole, the snap ring is provided at an inner wall of the connecting channel, and an inner diameter of the connecting hole is smaller than the outer diameter of the post head and is greater than or equal to the outer diameter of the post body. The post body is also capable of passing through the connecting hole to limit the post head in the connecting hole.

In an example, a periphery of the post body is provided with a first chuck and a second chuck, the first chuck is located between the second chuck and the post head, and a portion of the post body located between the first chuck and the second chuck is snap-fitted into the snap ring.

In an example, the first device has a first connecting surface, the connecting channel is provided in the first connecting surface; in a direction perpendicular to the first connecting surface, a side surface of the first chuck close to the post head does not extend beyond the first connecting surface.

In an example, the second device has a cavity and a second connecting surface, the connecting hole is provided in the second connecting surface and is communicated with the cavity, a portion of the post body located between the first chuck and the post head is snap-fitted in the connecting hole, and the post head is located in the cavity.

In an example, a peripheral surface of the post head is formed into a conical surface gradually necked in a direction away from the post body.

In an example, the supporting arm includes a first arm body and a second arm body, the first arm body is formed at an inner side of the snap ring and extends along a radial direction of the snap ring, one end of the second arm body is connected to the first arm body and the other end of the second arm body extends along an axis of the snap ring; an end face of one end of the snap-fitting slot close to the post head is provided with an extending slot concaved towards the post head, and at least a portion of the second arm body is snap-fitted in the extending slot.

In an example, the supporting arm is formed into a straight rod which is obliquely provided at an inner wall of the snap ring.

In an example, a connecting portion of the first arm body connected with the second arm body is provided with a reinforcing rib.

In an example, the connecting post is made of an elastic material.

On a second aspect, an embodiment of the present disclosure further provides a loudspeaker including the connecting structure described in any of the examples above, and the loudspeaker is configured to be connectable with a sound box through the connecting structure.

On a third aspect, an embodiment of the present disclosure further provides an electronic apparatus including a loudspeaker, a sound box, and the connecting structure described in any of the examples above; the loudspeaker is provided with a connecting channel, the sound box is provided with a connecting hole, and the loudspeaker is connected with the sound box through the connecting structure.

BRIEF DESCRIPTION OF THE DRAWINGS

Various objectives, features and advantages of the present disclosure will be more apparent from the following detailed description of exemplary embodiments of the present disclosure in conjunction with the drawings. The drawings are only exemplary illustrations of the present disclosure and are not necessary drawn to scale. Throughout the drawings, the same reference numeral indicates the same or similar part. In the drawings.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a", "an", and "the" are not intended to limit the amount, but indicate the existence of at least one. The terms "comprise", "comprising", "include", "including", etc., are intended to specify that the elements or the objects stated before these terms encompass the elements or the objects and equivalents thereof listed after these terms, but do not preclude the other elements or objects. The phrases "connect", "connected" and the like are not limited to a physical or mechanical connection, but also include an electrical connection, either directly or indirectly.

Figure 1:
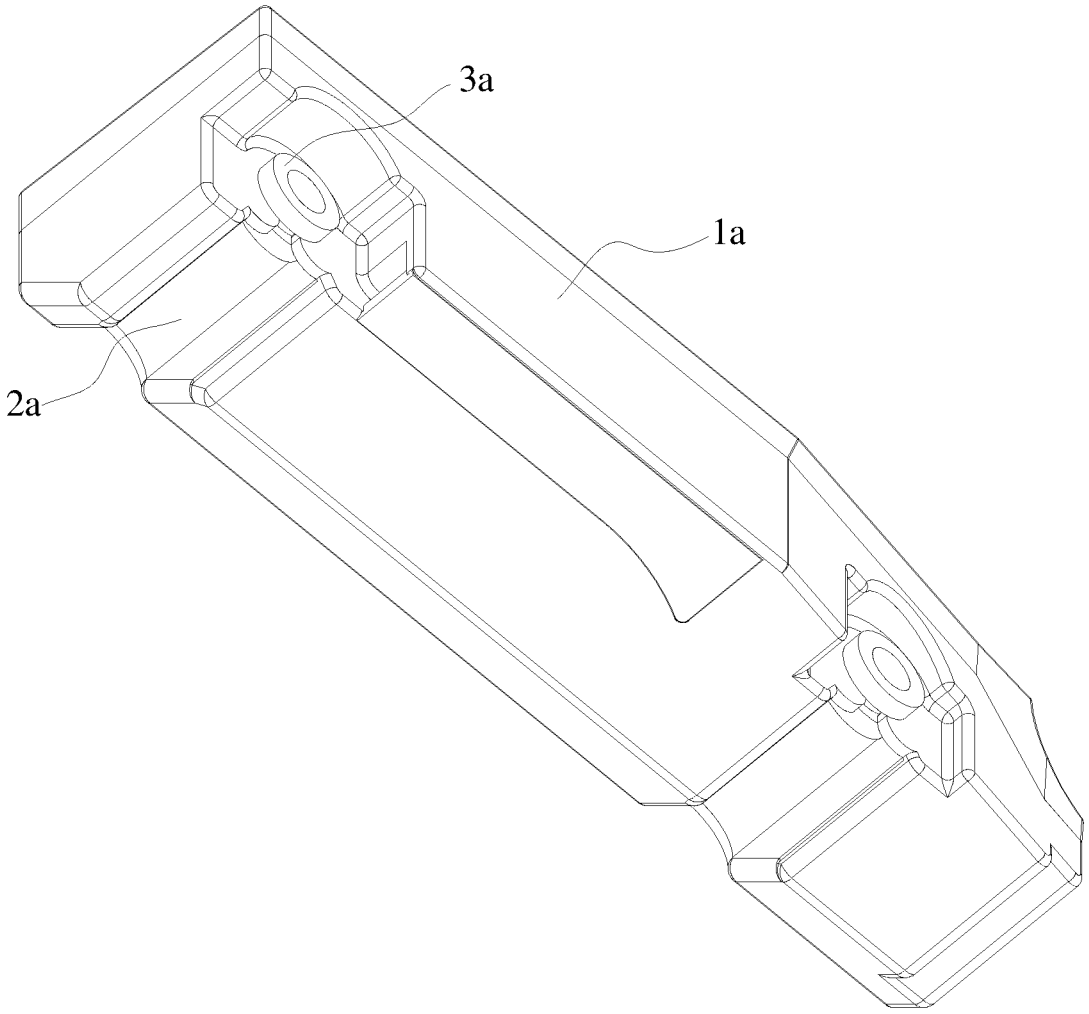
FIG. 1 is a structural diagram of a sound box.

FIG. 1 illustrates a connecting structure in an electronic apparatus, for connecting a loudspeaker with a sound box. As illustrated in FIG. 1, the loudspeaker 1*a* is provided with a recess 2*a* through which a screw can be passed; an interior of the recess 2*a* is provided with an annular structure 3*a* which can be engaged with the screw; the screw is capable of passing through the annular structure 3*a* to achieve a threaded connection. In such solution, for facilitate rotating the screw, it needs to reserve a larger space in the loudspeaker or the sound box, that is, the recess 2*a* has a greater length so as to facilitate rotating the screw, which reduces an available space in the device. At the same time, because the threaded element has a certain length, the sound box has to possess a certain thickness in a mounting direction of the threaded element so as to form a screw hole to be adapted to the length of the threaded element, thereby ensuring a stability of the connection. However, this may reduce a volume inside the sound box, which goes against a performance of the loudspeaker. Moreover, for a device using the threaded element for connection, a manufacturing method thereof requires for a tapping process to form a screw hole matched with the threaded element, which may result in a complicated manufacturing process and increase a cost.

Figure 2:
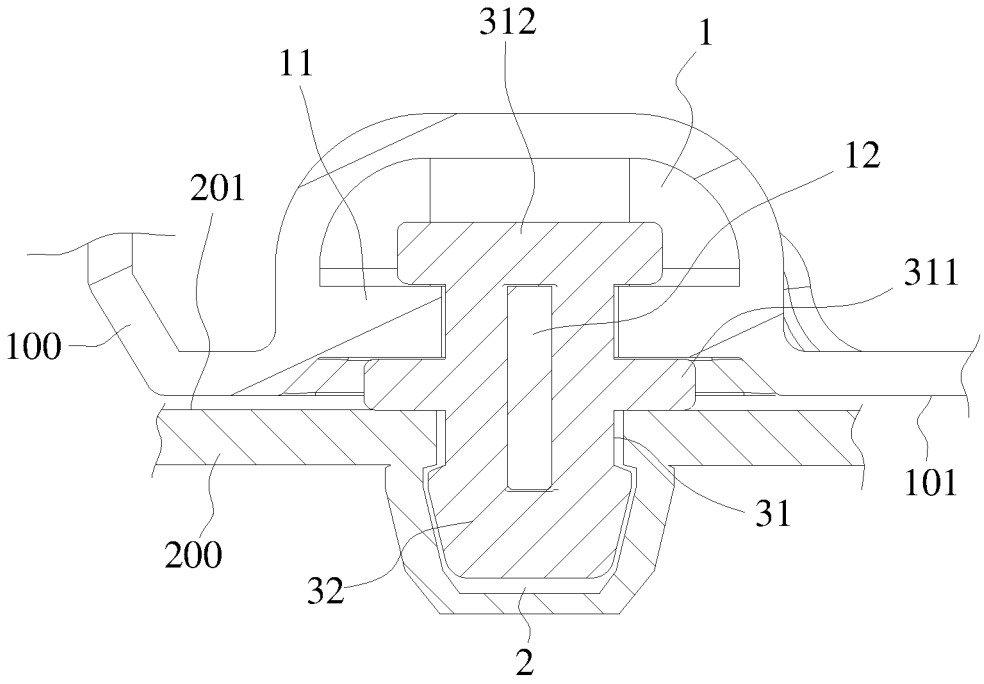
FIG. 2 is a structural diagram illustrating a connecting structure, a first device and a second device provided by an embodiment of the present disclosure.

An embodiment of the present disclosure provides a connecting structure. As illustrated in FIG. 2, the connecting structure provided by the embodiment of the present disclosure may be configured to connect a first device 100 with a second device 200. The first device 100 may have a first connecting surface 101, and the first connecting surface 101 may be provided with a connecting channel 1; the second device 200 may have a second connecting surface 201 and a cavity, and the second connecting surface 201 may be provided with a connecting hole 2 communicated with the cavity. The connecting hole 2 may be a hole directly provided in the second connecting surface 201, and may also be a hole in an elastic element fixed in a recess or an opening in the second device 200. A formation of the connecting hole 2 is not particularly limited in the embodiments of the present disclosure.

When the connecting structure provided by the embodiment of the present disclosure is used for connecting the first device 100 with the second device 200, the first connecting surface 101 is placed to be opposite to the second connecting surface 201. In an embodiment of the present disclosure, the first device 100 may be a loudspeaker, and the second device 200 may be a sound box. However, the embodiments are not limited thereto. For example, in some other embodiments, the first device 100 may also be a decorative product, a pendant, an attachment and the like; the second device 200 may also be a furniture, an electric appliance and the like. It should be explained that, when the second device 200 is a sound box, the second connecting surface 201 may be a housing of the sound box; the cavity of the second device 200 as mentioned above may be an inner space of the housing of the sound box, and may also be an independent chamber formed inside the housing of the sound box; the independent chamber and the connecting hole 2, together, may form a slotted hole structure with a orifice dimension smaller than that of the independent chamber, as illustrated in FIG. 2.

Figure 3:
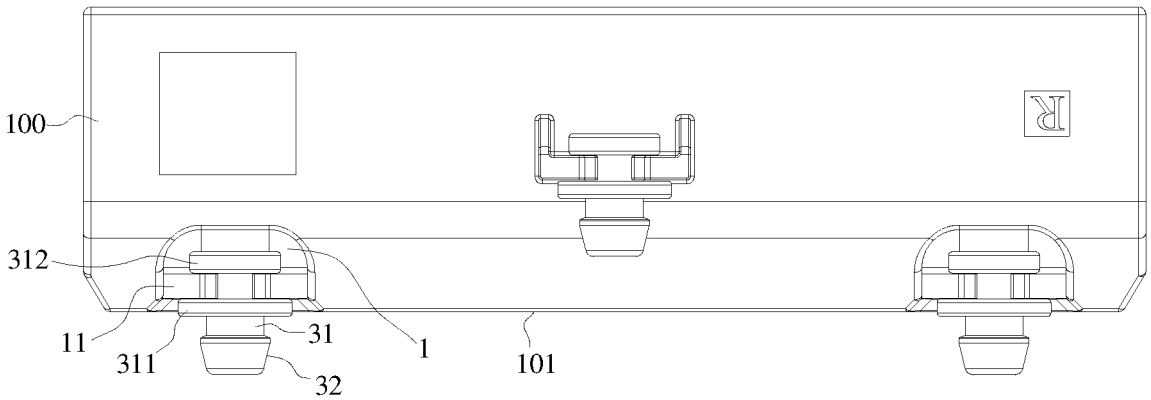
FIG. 3 is a front view illustrating a connecting structure and a first device provided by an embodiment of the present disclosure.
Figure 4:
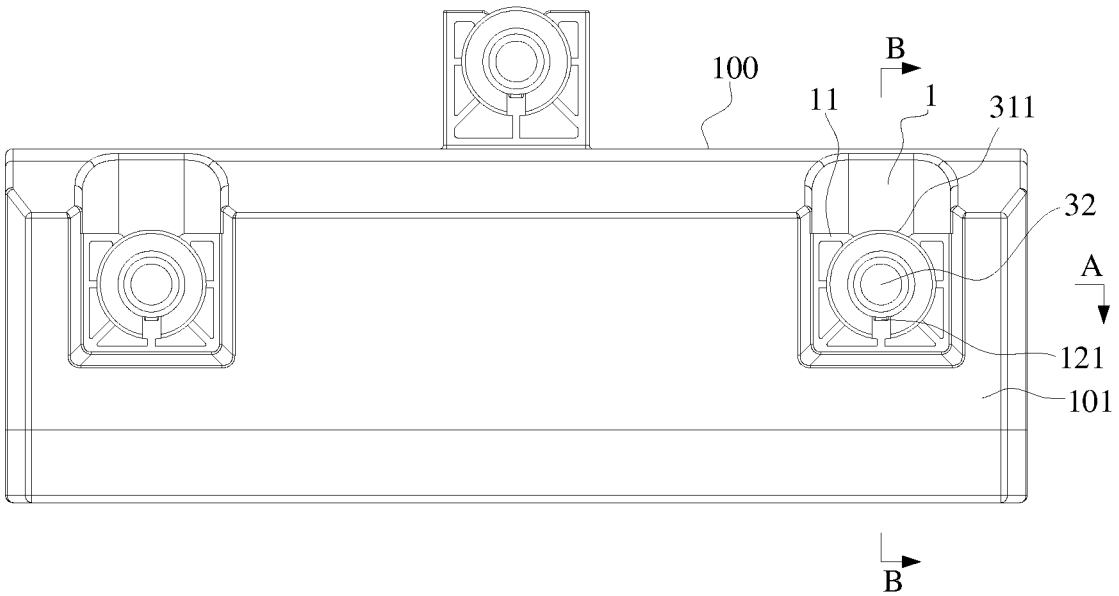
FIG. 4 is a bottom view of the connecting structure and the first device illustrated in FIG. 3.

As illustrated in FIGS. 2-4, the connecting structure provided by the embodiment of the present disclosure may include a snap ring 11 and a connecting post 3. Hereinafter, the structures of the snap ring 11 and the connecting post 3 will be described, by way of example, with reference to the first device 100 and the second device 200 to be engaged with the snap ring 11 and the connecting post 3, without limiting the embodiments of the present disclosure thereto.

As illustrated in FIGS. 3-4, in an embodiment, a side wall of the connecting channel 1 of the first device 100 may be provided with an opening, and the connecting post 3 of the connecting structure may enter the connecting channel 1 through the opening from a side direction of the connecting channel 1. Of course, in some other embodiments, the connecting channel 1 may be a structure with closed side wall (i.e., no opening is provided in the side wall). The snap ring 11 of the connecting structure may be provided at the side wall of the connecting channel 1, and the snap ring 11 may be provided with a notch, the notch is opposite to an opening of the connecting channel 1 and has a width greater than an inner diameter of the snap ring 11. The connecting post 3 may pass through the opening of the connecting channel 1 and the notch of the snap ring 11, in this order, so as to be snap-fitted into the snap ring 11. The snap ring 11 may be integrally formed with the side wall of the connecting channel 1, and may also be an independent structure from the side wall of the connecting channel 1 and fixed at the side wall of the connecting channel 1 by way of snap-fitting, adhering or the like.

Figure 5:
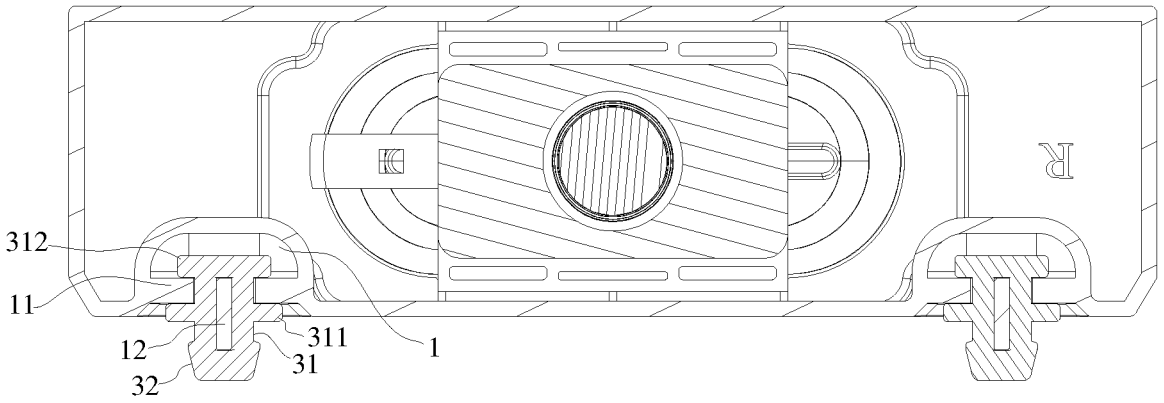
FIG. 5 is a cross-sectional view taken along A-A direction of FIG. 3.
Figure 6:
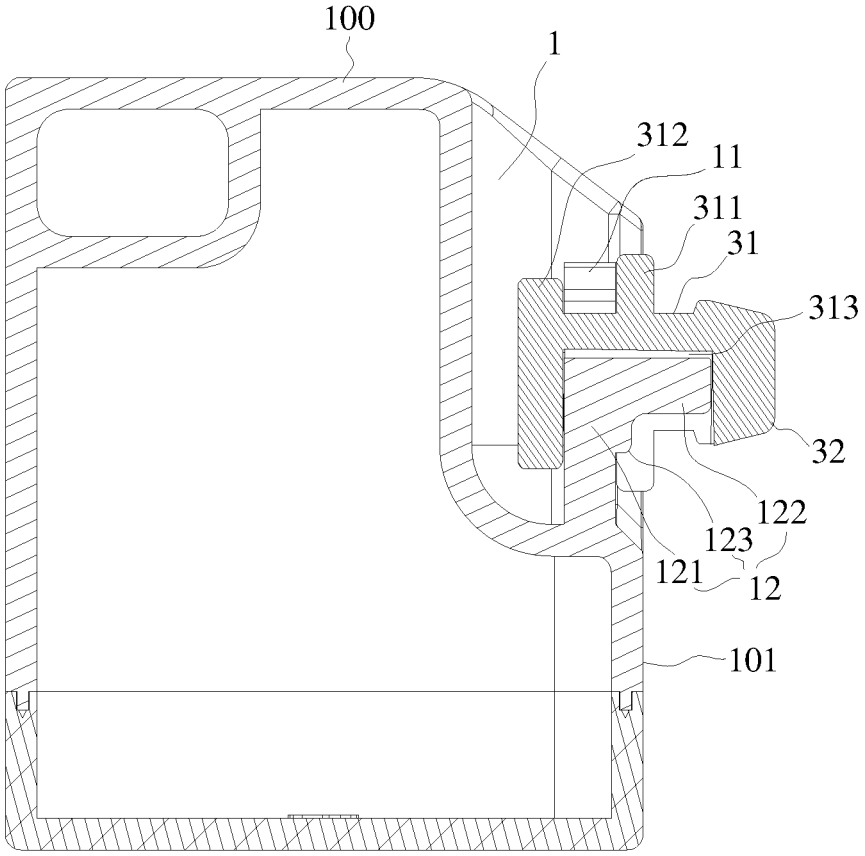
FIG. 6 is a cross-sectional view taken along B-B direction of FIG. 3.

As illustrated in FIGS. 5-6, in an embodiment, an inner wall of the snap ring 11 is further provided with a supporting arm 12. The supporting arm 12 may include a first arm body 121 and a second arm body 122. For example, one end of the first arm body 121 may be provided at the inner wall of the snap ring 11, and the other end of the first arm body 121 may extend along a radial direction of the snap ring 11; a length of the first arm body 121 is smaller than an inner diameter of the snap ring 11. The first arm body 121 may be formed integrally with the snap ring 11, and may also be fixedly connected with the snap ring 11 by way of snap-fitting, adhering or the like. For example, one end of the second arm body 122 may be provided at the first arm body 121, and the other end of the second arm body 122 may extend along a central axis of the snap ring 11 towards the second device 200 and may extend beyond the connecting channel 1. An included angle between the second arm body 122 and the first arm body 121 may be a right angle, and a connecting portion of the first arm body 121 connected with the second arm body 122 may be integrally formed with a reinforcing rib 123 to increase a strength of the connecting portion. For example, the second arm body 122 and the first arm body 121 may be integrally formed, and may also be fixedly connected by way of snap-fitting, adhering and the like.

In some other embodiments of the present disclosure, the supporting arm 12 may have other structures. For example, the supporting arm 12 may also be a straight rod obliquely provided at the inner wall of the snap ring 11. The other feasible structures of the supporting arm 12 will not be enumerated herein.

Figure 7:
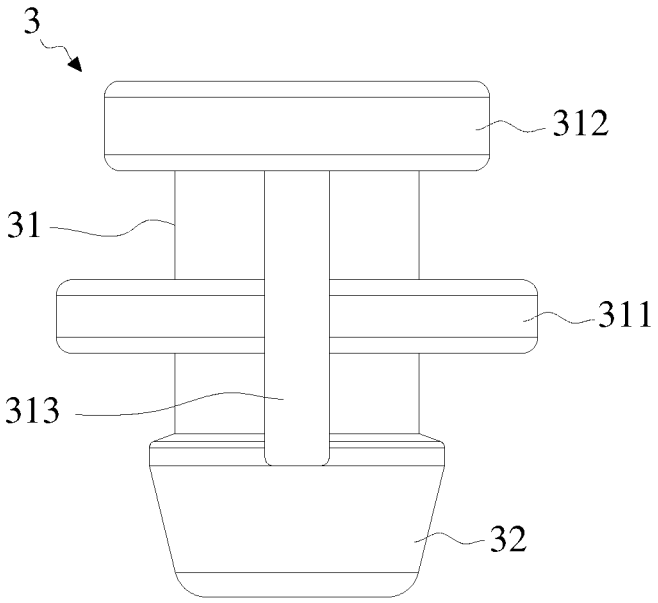
FIG. 7 is structural diagram illustrating a connecting post of a connecting structure provided by an embodiment of the present disclosure.

In an embodiment, a material of the connecting post 3 may be rubber. Of course, in some other embodiments of the present disclosure, the material of the connecting post 3 may be other elastic materials such as plastic, or may be non-elastic materials which may be snap-fitted with the snap ring 11. As illustrated in FIG. 7, in an embodiment, the connecting post 3 may include a post body 31 and a post head 32. An outer diameter of the post body 31 may be smaller than the inner diameter of the snap ring 11, or may be smaller than or equal to an inner diameter of the connecting hole 2, so that the post body 31 is capable of passing through the snap ring 11. The post head 32 may be integrally formed at one end of the post body 31, and an outer diameter of the post head 32 is greater than the outer diameter of the post body 31, so that the post head 32 is capable of protruding beyond a periphery of the post body 31. The outer diameter of the post head 32 is greater than the inner diameter of the connecting hole 2. During a mounting process, the post body 31 may be inserted into the connecting hole 2 of the second device 200 so that the post head 32 is located inside the connecting hole 2. For example, the post head 32 may pass through the connecting hole 2 to be positioned inside the cavity of the second device 200. Because the outer diameter of the post head 32 is greater than the inner diameter of the connecting hole 2, the post head 32 may be prevented from escaping from the connecting hole 2.

As illustrated in FIG. 5, in an embodiment, the periphery of the post body 31 may be integrally formed with a first chuck 311 and a second chuck 312. The second chuck 312 may be located at one end of the post body 31 away from the post head 32, and the first chuck 311 is located between the second chuck 312 and the post head 32. A distance between the first chuck 311 and the second chuck 312 may be as same as a thickness of the snap ring 11, so that the snap ring 11 is capable of being snap-fitted between the first chuck 311 and the second chuck 312; at the same time, a distance between the first chuck 311 and the post head 32 may be as same as a thickness of the second connecting surface 201 of the second device 200, so that the second connecting surface 201 is capable of being snap-fitted between the first chuck 311 and the post head 32 and that the post head 32 is capable of being positioned inside the cavity of the second device 200.

As illustrated in FIG. 7, in an embodiment, a side wall of the post body 31 may be provided with a snap-fitting slot 313, and an end face of one end of the snap-fitting slot 313 close to the post head 32 may be provided with an extending slot concaved towards the post head 32. When the post body 31 is snap-fitted in the snap ring 11, the supporting arm 12 may be adapted and snap-fitted into the snap-fitting slot 313. For example, the first arm body 121 may be protruded into the snap-fitting slot 313 along a radial direction of the post body 31, the second arm body 122 may be snap-fitted into the snap-fitting slot 313, and the end of the second arm body 122 may be protruded into the extending slot. In this way, the connecting post 3 may be supported by the supporting arm 12 to prevent the connecting post 3 from deformation; at the same time, with an engagement between the extending slot and the second arm body 122, it can prevent the connecting post 3 from automatically separating from the supporting arm 12.

In an embodiment, a side wall of the first chuck 311 close to the post head 32 may be flushed with the first connecting surface 101 of the first device 100 or may be located internally to the first connecting surface 101 so as to prevent the first chuck 311 from protruding beyond the first connecting surface 101; in this way, the first device 100 and the second device 200 may be attached onto each other upon being connected through the connecting structure, so as to save the space. A periphery of the post head 31 may be a conical surface, and the conical surface is gradually necked from the post body 31 in a direction away from the post body 31, so that the post head 32 can pass through the connecting hole 2 and enter the cavity. A shape and a dimension of the cavity may be matched with that of the post head 32.

In the connecting structure provided by an embodiment of the present disclosure, an end of the connecting post 3 away from the post head 32 may enter the snap ring 11 through the opening of the first device 100 and the notch of the snap ring 11, so that the snap ring 11 is clamped between the first chuck 311 and the second chuck 312; in this way, the connecting post 3 is snap-fitted with the snap ring 11. During this process, the supporting arm 12 may be snap-fitted in the snap-fitting slot 313, and the second arm body 122 may be protruded into the extending slot of the snap-fitting slot 313 so as to support the connecting post 3. In this way, the connecting post 3 may be detachably connected with the first device 100. At the same time, the post head 32 of the connecting post 3 may pass through the connecting hole 2 of the second device 200 to be protruded into the cavity of the second device 200, and an area between the first chuck 311 and the post head 32 may be snap-fitted with the connecting hole 2. Therefore, the connecting post 3 may be detachably connected with the second device 200.

To sum up, the first device 100 may be detachably connected with the second device 200 through the connecting post 3 and the snap ring 11, which avoids the use of a threaded element like screw and bolt, and omits the space to be preserved in the first device 100 and the second device 200 for rotating the threaded element, thereby improving the space utilization. At the same time, it eliminates the need of performing a tapping process on the first device 100 or the second device 200, which can simplify the process, felicitate the manufacture and reduce the manufacturing cost.

An embodiment of the present disclosure further provides a loudspeaker. Referring to FIG. 2, the loudspeaker may be configured to be connected to a sound box through the connecting structure provided by any of the embodiments above. In other words, the first device 100 in the foregoing description of the connecting structure may be the loudspeaker while the second device 200 may be the sound box.

The loudspeaker provided by the embodiment of the present disclosure allows for a connection with a sound box without using a threaded element (e.g., screw, screw hole, screw stud and the like), which facilitates reducing the occupied space inside the sound box and increases the volume inside the loudspeaker, so as to improve the performance of the loudspeaker. For example, a quality factor (Q value) of the loudspeaker may be improved.

An embodiment of the present disclosure further provides an electronic apparatus. Referring to FIG. 2, the electronic apparatus may include a loudspeaker, a sound box and a connecting structure provided by any of the embodiments above. The loudspeaker and the sound box are connected through the connecting structure.

In the present embodiment, the electronic apparatus, for example, may be a sound equipment including a loudspeaker and a sound box which are connected through the connecting structure provided by any of the embodiments above. In other words, the loudspeaker may be the first device 100 in any of the embodiments above while the sound box may be the second device 200 in any of the embodiments above. The connecting structure provided by the embodiments of the present disclosure is just configured to connect the loudspeaker to the sound box. For example, a housing of the loudspeaker is provided with the above-described connecting channel 1 so that the connecting post 3 can be snap-fitted into the connecting channel 1; a housing of the sound box is provided with the above-described connecting hole 2 so that the connecting post 3 snap-fitted at the loudspeaker can pass through the connecting hole 2; in this way, the post head 32 is limited inside the connecting hole 2, so as to achieve the connection between the loudspeaker and the sound box.

Accordingly, in the electronic apparatus provided by the embodiment of the present disclosure, the connecting solution of the loudspeaker and the sound box eliminates the use of threaded element (e.g., screw, screw hole, screw stud and the like), which reduces the occupied space inside the sound box and increases the volume inside the loudspeaker, so as to improve the performance of the loudspeaker. For example, the quality factor (Q value) of the loudspeaker may be improved.

The foregoing is only specific embodiments of the present disclosure, but the protection scope of the present disclosure is not limited thereto. Any modifications or alternations easily envisaged by one person skilled in the art within the technical scope of the present disclosure should fall within the protection scope of the present disclosure. Therefore, the protection scope of the present disclosure should be based on protection scope of the claims.

What is claimed is:

1. A connecting structure, comprising:

a snap ring provided with a notch, a width of the notch being greater than an inner diameter of the snap ring, and an inner wall of the snap ring being provided with a supporting arm; and a connecting post comprising a post body and a post head located at one end of the post body, an outer diameter of the post head being greater than an outer diameter of the post body, and the post body being provided with a snap-fitting slot, wherein the post body of the connecting post is configured to be capable of passing through the notch of the snap ring to be snap-fitted in the snap ring, and the supporting arm of the snap ring is configured to be capable of being snap-fitted in the snap-fitting slot of the connecting post, wherein a periphery of the post body is provided with a first chuck and a second chuck, the first chuck is located between the second chuck and the post head, and a portion of the post body located between the first chuck and the second chuck is snap-fitted into the snap ring.

2. The connecting structure according to claim 1, configured to connect a first device with a second device, wherein the first device is provided with a connecting channel and the second device is provided with a connecting hole, the snap ring is provided at an inner wall of the connecting channel, and an inner diameter of the connecting hole is smaller than the outer diameter of the post head and is greater than or equal to the outer diameter of the post body, and the post body is configured to be capable of passing through the connecting hole to limit the post head in the connecting hole.

3. The connecting structure according to claim 1, wherein the first device has a first connecting surface, the connecting channel is provided in the first connecting surface, and in a direction perpendicular to the first connecting surface, a side surface of the first chuck close to the post head does not extend beyond the first connecting surface.

4. The connecting structure according to claim 1, wherein the second device has a cavity and a second connecting surface, the connecting hole is provided in the second connecting surface and is communicated with the cavity, and a portion of the post body located between the first chuck and the post head is snap-fitted in the connecting hole, and the post head is located in the cavity.

5. The connecting structure according to claim 4, wherein a peripheral surface of the post head is formed into a conical surface gradually necked in a direction away from the post body.

6. The connecting structure according to claim 1, wherein the supporting arm comprises a first arm body and a second arm body, the first arm body is formed at an inner side of the snap ring and extends along a radial direction of the snap ring, one end of the second arm body is connected to the first arm body and the other end of the second arm body extends along an axis of the snap ring:

an end face of one end of the snap-fitting slot close to the post head is provided with an extending slot concaved towards the post head, and at least a portion of the second arm body is snap-fitted in the extending slot.

7. The connecting structure according to claim 6, wherein a connecting portion of the first arm body connected with the second arm body is provided with a reinforcing rib.

8. The connecting structure according to claim 1, wherein the supporting arm is formed into a straight rod which is obliquely provided at an inner wall of the snap ring.

9. The connecting structure according to claim 1, wherein the connecting post is made of an elastic material.

10. A loudspeaker, comprising the connecting structure according to claim 1, wherein the loudspeaker is configured to be connectable with a sound box through the connecting structure.

11. An electronic apparatus, comprising a loudspeaker, a sound box, and the connecting structure according to claim 1, wherein the loudspeaker is provided with a connecting channel, the sound box is provided with a connecting hole, and the loudspeaker is connected with the sound box through the connecting structure.

12. The electronic apparatus according to claim 11, wherein the snap ring is provided at an inner wall of the connecting channel, and an inner diameter of the connecting hole is smaller than the outer diameter of the post head and is greater than or equal to the outer diameter of the post body, and the post body is configured to be capable of passing through the connecting hole to limit the post head in the connecting hole.

13. The electronic apparatus according to claim 11, wherein the loudspeaker has a first connecting surface, the connecting channel is provided in the first connecting surface, and in a direction perpendicular to the first connecting surface, a side surface of the first chuck close to the post head does not extend beyond the first connecting surface.

14. The electronic apparatus according to claim 11, wherein the sound box has a cavity and a second connecting surface, the connecting hole is provided in the second connecting surface and is communicated with the cavity, and a portion of the post body located between the first chuck and the post head is snap-fitted in the connecting hole, and the post head is located in the cavity.

15. The electronic apparatus according to claim 14, wherein a peripheral surface of the post head of the connecting post of the connecting structure is formed into a conical surface gradually necked in a direction away from the post body of the connecting post.

16. The electronic apparatus according to claim 11, wherein the supporting arm of the connecting structure comprises a first arm body and a second arm body, the first arm body is formed at an inner side of the snap ring and extends along a radial direction of the snap ring, one end of the second arm body is connected to the first arm body and the other end of the second arm body extends along an axis of the snap ring;

an end face of one end of the snap-fitting slot close to the post head is provided with an extending slot concaved towards the post head, and at least a portion of the second arm body is snap-fitted in the extending slot.

17. The electronic apparatus according to claim 11, wherein the supporting arm of the connecting structure is formed into a straight rod which is obliquely provided at an inner wall of the snap ring.

18. A connecting structure, comprising:

a snap ring provided with a notch, a width of the notch being greater than an inner diameter of the snap ring, and an inner wall of the snap ring being provided with a supporting arm; and a connecting post comprising a post body and a post head located at one end of the post body, an outer diameter of the post head being greater than an outer diameter of the post body, and the post body being provided with a snap-fitting slot;

wherein the post body of the connecting post is configured to be capable of passing through the notch of the snap ring to be snap-fitted in the snap ring, and the supporting arm of the snap ring is configured to be capable of being snap-fitted in the snap-fitting slot of the connecting post, the connecting structure is configured to connect a first device with a second device, wherein the first device is provided with a connecting channel and the second device is provided with a connecting hole, the snap ring is provided at an inner wall of the connecting channel, and an inner diameter of the connecting hole is smaller than the outer diameter of the post head and is greater than or equal to the outer diameter of the post body, and the post body is configured to be capable of passing through the connecting hole to limit the post head in the connecting hole.

19. A connecting structure, comprising:

a snap ring provided with a notch, a width of the notch being greater than an inner diameter of the snap ring, and an inner wall of the snap ring being provided with a supporting arm; and a connecting post comprising a post body and a post head located at one end of the post body, an outer diameter of the post head being greater than an outer diameter of the post body, and the post body being provided with a snap-fitting slot;

wherein the post body of the connecting post is configured to be capable of passing through the notch of the snap ring to be snap-fitted in the snap ring, and the supporting arm of the snap ring is configured to be capable of being snap-fitted in the snap-fitting slot of the connecting post, the supporting arm comprises a first arm body and a second arm body, the first arm body is formed at an inner side of the snap ring and extends along a radial direction of the snap ring, one end of the second arm body is connected to the first arm body and the other end of the second arm body extends along an axis of the snap ring, and an end face of one end of the snap-fitting slot close to the post head is provided with an extending slot concaved towards the post head, and at least a portion of the second arm body is snap-fitted in the extending slot.

* * * * *